US008587186B2

(12) United States Patent
Hoetzl et al.

(10) Patent No.: US 8,587,186 B2
(45) Date of Patent: Nov. 19, 2013

(54) LAMP HAVING GAS FILLING

(75) Inventors: Guenter Hoetzl, Regensburg (DE); Stefan Lorenz, Obertraubling (DE)

(73) Assignee: OSRAM AG, Munich (DE)

( * ) Notice: Subject to any disclaimer, the term of this patent is extended or adjusted under 35 U.S.C. 154(b) by 0 days.

(21) Appl. No.: 13/578,829

(22) PCT Filed: Jan. 27, 2011

(86) PCT No.: PCT/EP2011/051107

§ 371 (c)(1), (2), (4) Date: Aug. 14, 2012

(87) PCT Pub. No.: WO2011/098358

PCT Pub. Date: Aug. 18, 2011

(65) Prior Publication Data

US 2012/0306340 A1 Dec. 6, 2012

(30) Foreign Application Priority Data

Feb. 15, 2010 (DE) ..... 10 2010 001 931

(51) Int. Cl.
*H01J 5/16* (2006.01)

(52) U.S. Cl.
USPC ..... 313/110; 362/255

(58) Field of Classification Search
None
See application file for complete search history.

(56) References Cited

U.S. PATENT DOCUMENTS

| | | | | |
|---|---|---|---|---|
| 3,860,847 | A * | 1/1975 | Carley | 313/110 |
| 3,912,959 | A * | 10/1975 | Muta et al. | 313/624 |
| 2004/0201990 | A1 | 10/2004 | Meyer | |
| 2010/0213809 | A1 | 8/2010 | Roehl et al. | |

FOREIGN PATENT DOCUMENTS

| | | | |
|---|---|---|---|
| DE | 68926844 | T2 | 2/1997 |
| DE | 10260432 | A1 | 7/2004 |
| DE | 102008008599 | A1 | 6/2009 |
| EP | 0370318 | A2 | 5/1990 |
| EP | 1471564 | A2 | 10/2004 |
| GB | 716642 | A | 10/1954 |
| GB | 2366610 | A | 3/2002 |
| JP | 2009277586 | A | 11/2009 |
| WO | 2009037053 | A1 | 3/2009 |
| WO | 2009040703 | A2 | 4/2009 |
| WO | 2010052538 | A1 | 5/2010 |

OTHER PUBLICATIONS

English Abstract DE 10260432 A1. Jul. 8, 2004
English Abstract DE 102008008599 A1. Jun. 25, 2009.
English Abstract of JP 2009277586 A, dated Nov. 26, 2009.

* cited by examiner

*Primary Examiner* — Mary Ellen Bowman

(57) ABSTRACT

In various embodiments, a lamp is provided. The lamp may include at least one solid light source which is installed on a carrier; an at least partially light-permeable vessel, which encloses the light source and the carrier in a gas-tight manner and a filling gas, which is enclosed in the vessel, wherein the filling gas is a mixture of at least one gas having high thermal conductivity and at least one gas having a different physical property.

13 Claims, 2 Drawing Sheets

LAMP HAVING GAS FILLING

RELATED APPLICATIONS

The present application is a national stage entry according to 35 U.S.C. §371 of PCT application No.: PCT/EP2011/051107 filed on Jan. 27, 2011, which claims priority from German application No.: 10 2010 001 931.3 filed on Feb. 15, 2010.

TECHNICAL FIELD

Various embodiments relate to a lamp having gas filling.

BACKGROUND

A lamp having gas filling is known from EP 1 471 564 A2. The LED lamp described therein is formed from a solid light source, which is installed on a carrier structure. A light-permeable vessel encloses the light source and carrier structure and an electrical input lead and return lead are fed into and out of the housing in order to supply the light source with electrical energy. A filling gas with a low molecular weight, such as helium or hydrogen, is enclosed in the vessel, which is in thermal contact with the light source.

This known LED lamp uses the thermal conductivity of helium for efficient cooling of the LED, wherein the heat is transported via the helium filling to the vessel walls. However, one drawback of the helium filling is the high price of this gas, while cheaper gases, such as, for example, hydrogen and nitrogen, have poorer heat conduction. Better heat conduction can be achieved by mixing these gases with air, but this results in an explosive mixture leading to undesirable vessel breakages. In addition, helium places high requirements on the tightness of the vessel.

SUMMARY

Various embodiments provide a lamp with a gas filling which is inexpensive to produce and has excellent thermal conductivity in combination with other physical properties, such as pressure compensation and light filtering.

According to various embodiments, the lamp is filled with a filling gas, which is a mixture of at least one gas having high thermal conductivity and at least one gas having a different physical property. This solution may have the advantage that the light sources in the lamp are efficiently cooled as a result of the high thermal conductivity of a first component of the filling gas, while, due to the presence of a second gas component, the filling gas is also able simultaneously to carry out further functions in the lamp, which would otherwise have to be performed by separate components in the lamp. This significantly increase the production costs of the lamp. Further functions of the lamp are, for example, pressure compensation and light filtering.

In a preferred embodiment of the present invention, the gas with high conductivity is selected from the group helium and hydrogen, wherein, as a better heat conductor with inert properties, it is particularly preferable to use helium.

It has proven to be advantageous for the proportion of the gas having high thermal conductivity in the filling gas mixture to be 1-80%, preferably 1-10% and in particular 8 and 10%. It may be generally stated that the proportion of the second component, i.e. of the gas having a different physical property, is 100%−x (proportion of gas with high conductivity).

A particular advantage of the present invention can be considered to be the fact that if, for example, helium is used as a gas having high thermal conductivity, it is used in a relatively low volume, which significantly reduces the production costs of the lamp.

The gas having a different physical property, which is present in the filling gas mixture together with the gas with high thermal conductivity, as a rule has lower reactivity than the gas with high thermal conductivity. The gases of the second component make it possible to achieve, for example, high internal vessel pressures, optical light variations, such as light filtering and improved luminous efficiency. Examples of a gas with different physical properties include nitrogen, argon, air, helium, neon, carbon dioxide, nitrogen dioxide or sulfur hexafluoride. If helium is selected as a gas, the gas of the first component will not be helium.

In practice, the gas pressure in the vessel is between $10^{-2}$ and 1200 hPa, wherein a preferred gas pressure is between $10^{-1}$ and 100 hPa.

In a preferred embodiment of the present invention, the solid light source of the lamp according to the invention is a light-emitting diode (LED) or a solid-state laser. Usually, this is a chip installed directly on a heat-conducting carrier. In one embodiment, the chip is not coated or sealed with an epoxy resin or any other coating material so that it is in direct contact with the filling gas mixture.

The lamp according to the invention is surrounded by an at least partially light-permeable vessel containing the solid light source and the filling gas mixture. In a preferred embodiment, the vessel is made of glass. However, it is also possible to provide vessels made of plastic and transparent and partially transparent ceramics. The vessel walls can be structured in order to endow the light source with a specific optical appearance.

The carrier can assume different shapes, such as, for example, a plate with a wide variety of dimensions or a bar. A preferred carrier preferably comprises a holder arranged between an electrical input lead and an output lead.

The solid light source, such as, for example, an LED can be arranged as a plurality of light sources in series on the carrier. In this case, the carrier can be formed from a printed circuit board material.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description, various embodiments of the invention are described with reference to the following drawings, in which.

PREFERRED EMBODIMENTS OF THE INVENTION DETAILED DESCRIPTION

The following detailed description refers to the accompanying drawings that show, by way of illustration, specific details and embodiments in which the invention may be practiced.

Figure 1:
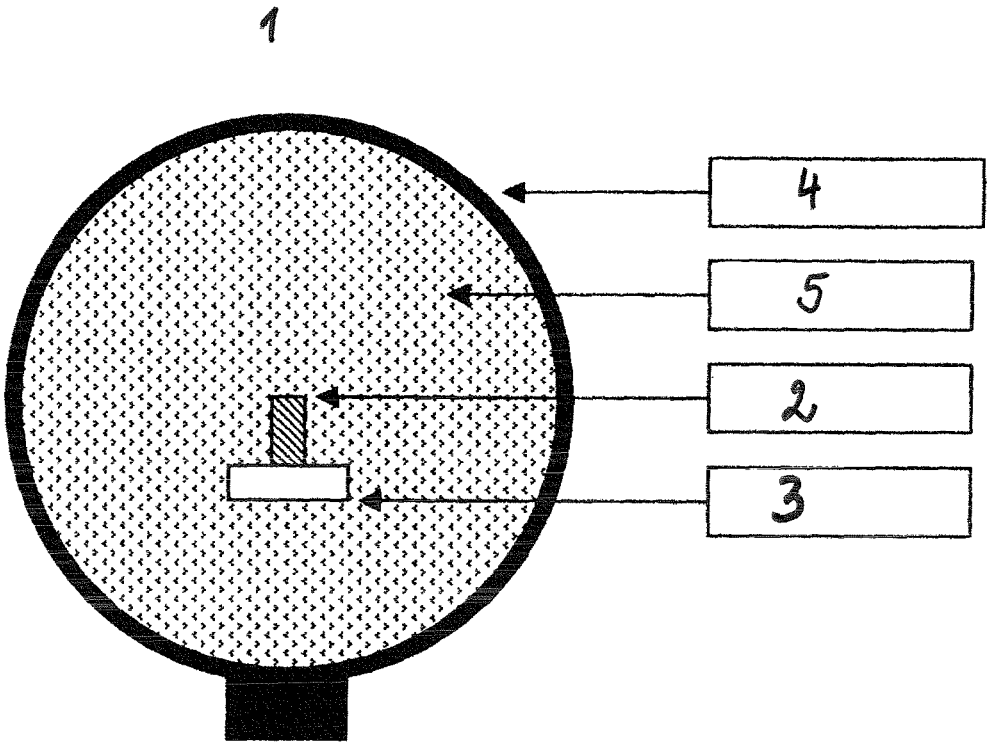
FIG. 1 a schematic longitudinal section of an embodiment of the lamp according to the invention FIG. 2 a schematic drawing of an embodiment of the present invention, wherein a plurality of LED light sources is arranged in series on a carrier.

FIG. 1 is a schematic longitudinal section of an embodiment of a lamp 1 according to the invention. The lamp includes an LED light source 2 disposed on a carrier 3. The light source and carrier are installed in a gas-tight vessel 4. The vessel is at least partially light-permeable. The vessel contains a gas mixture of at least one gas having high thermal conductivity and at least one gas having a different physical property 5. The gas mixture 5 is in contact with the LED light source 2 and the vessel 4 and optionally also with the carrier 3. More than half of the heat falling on the LED light source is transmitted directly via the path LED->filling gas->vessel or indirectly via the path LED->carrier->filling gas->vessel via the filling gas 5 to the vessel wall.

The filling gas includes a mixture of at least one gas having high thermal conductivity and at least one gas having a different physical property. Helium or hydrogen may be used as the gas having high thermal conductivity, for example. The gas having a different physical property may be, for example, nitrogen, argon, air, helium, neon, $CO_2$, $O_2$ or $SF_6$.

Figure 2:
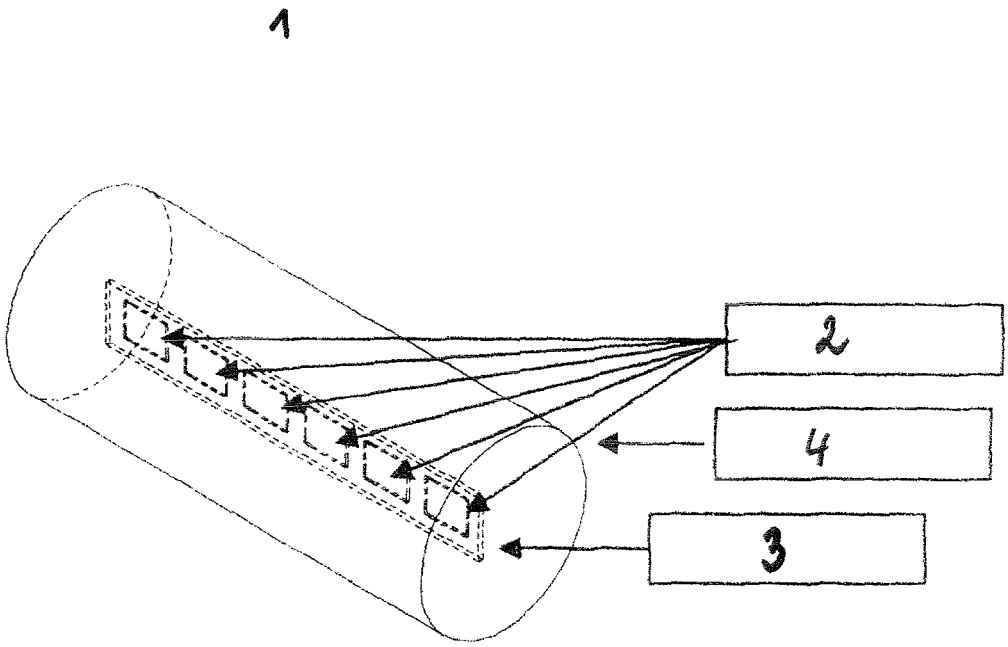

FIG. 2 is a schematic representation of another embodiment of the lamp 1 according to the invention. In this embodiment, the vessel 4 is cylindrical. The diameter is 25 mm. The LEDs 2 are installed in series on a carrier 3 and are surrounded by filling gas 5. The vessel is made of glass. The carrier, which is made of a printed circuit board material, for example FR4 or MCPCB, is secured on the glass bulb with holding wires so that the LEDs are able to illuminate the complete vessel wall directly or indirectly. The carrier can also be secured to the end caps (not shown).

In both embodiments, an electrical input lead and an electrical return lead, which are thermally conductive, are provided below the carrier (not shown). For example, copper or a similar material, which is highly thermally conductive, can be used as for the electrical input lead and return lead. The carrier structure can also comprise cooling elements. The lamp according to the invention may also include further elements, such as, for example, described in EP 1 471 564 A2.

The invention is now explained below in more detail with reference to exemplary embodiments.

Exemplary embodiment 1: a filling gas mixture of helium/nitrogen ($N_2$) is used in a lamp according to the invention. The proportion of helium is 50%. The pressure in the lamp is 100 hPa. Here, there is good thermal conductivity with a high internal vessel pressure and hence the mechanical stress is low. In addition, the helium consumption is lower compared that of helium-filled lamps known from the prior art. The advantageous ranges for the quantitative composition of this gas mixture and the pressures are 20%<He<80%; 50 hPa<P<500 hPa.

Exemplary embodiment 2: a filling gas mixture with helium/argon is used. The helium proportion in the filling gas mixture is 10%. The internal vessel pressure was set at 100 hPa. It has been found that this gas mixture ensures high thermal conductivity with a high internal vessel pressure, which means the mechanical stress is low. In this embodiment, the helium consumption is even lower compared to the gas component with lower reactivity. The following ranges have been found to be advantageous with this filling gas mixture: 5%<He<20%; 50 hPa<P<500 hPa.

Exemplary embodiment 3: the gas mixture is composed of helium/argon, wherein the proportion of helium in the gas mixture is 10%. The pressure is 10 hPa. Compared to examples 1 and 2, the thermal conductivity is higher and the gas consumption lower. Here, the advantageous ranges are as follows: 5%<He<20%; 1 hPa<P<50 hPa.

Exemplary embodiment 4: a filling gas mixture of hydrogen/helium with a hydrogen content of 4% is used. The pressure is 10 hPa. It has been established that this filling gas mixture has excellent thermal conductivity and the hydrogen remains inactive. The advantageous ranges for this filling gas mixture are as follows: 0.1%<hydrogen<4%; 0.1 hPa<P<20 hPa.

Exemplary embodiment 5: a gas mixture of helium and air is used to fill an LED lamp. The proportion of helium in the gas mixture is 1%, the pressure is 100 hPa. This gas mixture has been found have good thermal conductivity and a high internal vessel pressure. Once again, the helium consumption is very low. The thermal conductivity has been found to be higher than is the case with air. Here, the advantageous ranges are as follows: 0.1%<helium<2%; 80 hPa<P<200 hPa.

Exemplary embodiment 6: a gas mixture of helium/nitrogen dioxide ($NO_2$) is used to fill the LED lamp. The proportion of helium is 20%, the pressure is 100 hPa. This gas mixture has high thermal conductivity with a high internal vessel pressure, wherein optical light variation is observed. However, this gas mixture has the drawback of being toxic so that it necessary to ensure that the lamp is completely sealed. Here, the advantageous ranges are as follows: 20%<helium<80%; 10 hPa<P<200 hPa.

Exemplary embodiment 7: a filling gas mixture of helium/sulfur hexafluoride ($SF_6$) is used, wherein the proportion of helium in the gas mixture is 20%. The pressure is 1 hPa. This gas mixture was found to have good thermal conductivity, wherein simultaneously the electrical dielectric strength is increased. It is characterized by minimal gas consumption. The advantageous ranges were determined as follows: 20%<helium<80%; 10 hPa<P<200 hPa.

Exemplary embodiment 8: a gas mixture of helium/carbon dioxide (C02) is used, wherein the proportion of helium is 50%. The pressure is 900 hPa. This has significantly improved thermal conductivity with pressure compensation with respect to the external pressure. The advantageous ranges are as follows: 40% <helium<70%; 800 hPa<P<1200 hPa.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

The invention claimed is:

1. A lamp, comprising:

at least one solid light source which is installed on a carrier;

an at least partially light-permeable vessel, which encloses the light source and the carrier in a gas-tight manner and a filling gas, which is enclosed in the vessel, wherein the filling gas is a mixture of at least two gases, at least one of the at least two gases having high thermal conductivity, wherein the gas having high thermal conductivity is selected from the group helium and hydrogen.

2. The lamp as claimed in claim 1, wherein the gas having high thermal conductivity is helium.

3. The lamp as claimed in claim 1, wherein at least one of the at least one gas not having a high thermal conductivity is from the group nitrogen, argon, air, neon, carbon dioxide, nitrogen dioxide, or sulfur hexafluoride.

4. The lamp as claimed in claim 1, wherein the gas pressure in the vessel is between 10.sup.-2 and 1200 hPa.

5. The lamp as claimed in claim 1, wherein the proportion of the gas having high thermal conductivity in the filling gas mixture is 1 to 80%.

6. The lamp as claimed in claim 1, wherein the solid light source is one of a light-emitting diode and a solid-state laser.

7. The lamp as claimed in claim 1, wherein the at least partially light-permeable vessel is made of glass.

8. The lamp as claimed in claim 1, wherein the at least partially light-permeable vessel is made of one of a transparent and partially transparent ceramic.

9. The lamp as claimed in claim 1, wherein a plurality of light sources are arranged in series on the carrier.

10. The lamp as claimed in claim 9, wherein the carrier is made of a printed circuit board material.

11. The lamp as claimed in claim 4, wherein the gas pressure in the vessel is between 10.sup.-1 and 100 hPa.

12. The lamp as claimed in claim 5, wherein the proportion of the gas having high thermal conductivity in the filling gas mixture is 1 to 10%.

13. The lamp as claimed in claim 12, wherein the proportion of the gas having high thermal conductivity in the filling gas mixture is 8 and 10%.

* * * * *